US006958593B2

(12) United States Patent
Asanuma et al.

(10) Patent No.: US 6,958,593 B2
(45) Date of Patent: Oct. 25, 2005

(54) POWER SUPPLY APPARATUS

(75) Inventors: Kazuo Asanuma, Tokyo (JP); Mamoru Sakamoto, Tokyo (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 43 days.

(21) Appl. No.: 10/698,434

(22) Filed: Nov. 3, 2003

(65) Prior Publication Data

US 2004/0100238 A1 May 27, 2004

(30) Foreign Application Priority Data

Nov. 26, 2002 (JP) ..... 2002-342796

(51) Int. Cl.[7] ..... G05F 1/44
(52) U.S. Cl. ..... 323/282
(58) Field of Search ..... 323/222–225, 323/282, 284–286

(56) References Cited

U.S. PATENT DOCUMENTS 5,013,998 A * 5/1991 Varga et al. ..... 323/285
5,583,752 A 12/1996 Sugimoto et al.
5,844,403 A 12/1998 Sugimoto et al.
6,737,841 B2 * 5/2004 Wrathall ..... 323/282
6,760,633 B1 * 7/2004 Young ..... 700/44

* cited by examiner

*Primary Examiner*—Gary L Laxton
(74) *Attorney, Agent, or Firm*—Oliff & Berridge, PLC

(57) ABSTRACT

This invention provides a stable power supply apparatus enabling the high speed response. Hitherto, it was necessary to secure both of the gain margin and the phase margin on the Bode diagram of the loop transfer function when the PID feedback control was carried out in the power supply apparatus. The form of the transfer function of the controller in the power supply apparatus of this invention is the same, but a set of coefficient values in the transfer function is completely different, and the controller secures only the phase margin without securing the gain margin. Furthermore, the transfer function of the controller indicates a part with an extreme decrease in the gain and a trap point in which the phase is sharply delayed on the Bode diagram. This is achieved by applying the integral element of the PID to a frequency range that is higher than the resonance frequency of the LC filter. As a result, the high speed response becomes possible without losing the stability. Moreover, there is no case in which difficulty as to the setting of the circuit constants rises.

8 Claims, 13 Drawing Sheets

| | |
|---|---|
| R1 | 1kΩ |
| R2 | 98Ω |
| R3 | 710kΩ |
| R4 | 2.2kΩ |
| C1 | 2.2nF |
| C2 | 1nF |

| | |
|---|---|
| Vi | 6V |
| Vo | 2.5V |
| Io | 1A(max) |
| L | 3μH |
| C | 9.4μF |
| Ro | 2.5Ω |
| Vref | 2.5V |
| Kp | ×10 |

| | |
|---|---|
| R1 | 1kΩ |
| R2 | 25Ω |
| R3 | 70kΩ |
| R4 | 550Ω |
| C1 | 10nF |
| C2 | 14nF |

| | |
|---|---|
| R1 | 1kΩ |
| R2 | 60Ω |
| R3 | 430kΩ |
| R4 | 1.4kΩ |
| C1 | 3.3nF |
| C2 | 1.8nF |

POWER SUPPLY APPARATUS

TECHNICAL FIELD OF THE INVENTION

This invention relates to a power supply apparatus, more particularly to a feedback control technique in the power supply apparatus.

BACKGROUND OF THE INVENTION

A block diagram of a conventional power supply apparatus is shown in FIG. 17. In this block diagram, an output voltage Vo is negatively fedback, and is subtracted from a reference voltage Vref, and its calculation result (Vref−Vo) is input to a transfer function PID corresponding to a PID controller. An output of this transfer function PID is added with the feed forward reference voltage Vref, and the addition result is input to a transfer function PW corresponding to a power converter circuit. An output of the transfer function PW is input to a transfer function LC corresponding to an LC filter and the like, and an output of the transfer function LC is the output voltage Vo. Incidentally, the PID controller is a controller combining a proportional (P) element, integral (I) element and differential (D) element. Conventionally, to stably control a system, both of the gain margin and the phase margin were needed to be secured in the Bode diagram of a loop transfer function consisting of the transfer function PID of the PID controller, transfer function PW corresponding to the power converter circuit, and transfer function LC of the LC filter and the like. FIG. 18 is a Bode diagram of the loop transfer function of a conventional power supply apparatus, and the upper diagram shows the frequency characteristic of the gain and the lower diagram shows the frequency characteristic of the phase. The phase margin is phase width from −180 degrees at a frequency at which the gain becomes 0 dB on the Bode diagram as shown in FIG. 18. The phase margin from 45 to 60 degrees or more is usually needed. Moreover, as shown in FIG. 18, the gain margin is gain width from 0 dB on a minus side at a frequency at which the phase is delayed up to −180 degrees. The gain margin of 6 dB or more is needed usually.

Specifically, following designs are performed under such a stability condition. That is, though the integral element is applied from the low frequency range to solve the steady-state deviation, since the LC filter to be controlled is a second order lag system and the phase delay of 180 degrees occurs at frequencies equal to or higher than the resonance frequency, the application of the integral element is terminated at a frequency that is lower than the resonance frequency, so that the large phase delay does not occur at frequencies equal to or higher than the resonance frequency. And, to secure the phase margin and the gain margin, the differential element is applied from the vicinity of the resonance frequency. However, in such a conventional power supply apparatus, since the controller is designed while securing both of the gain margin and phase margins, it is difficult to achieve the high gain and high speed response.

Moreover, for example, U.S. Pat. No. 5,844,403 discloses a circuit as shown in FIG. 19. That is, a power supply apparatus shown in FIG. 19 is composed of a power converter 1002, input power supply 1003, smoothing circuit 1004, load 1005, and controller 1000. The controller 1000 has resistors R11 to R17, capacitors C11 and C12 and an amplifier 1011. One terminal of the resistor R11 and resistor R14 is respectively connected to a positive polarity side of the load 1005, another terminal of the resistor R11 is connected to a negative input terminal of the amplifier 1011 and one terminal of the resistors R12 and R13, and another terminal of the resistor R14 is connected to one terminal of the resistors R15 and R16 and capacitor C12. Another terminal of the resistors R12 and R15 and capacitor C12 is grounded. Moreover, another terminal of the resistor R13, whose one terminal is connected to the resistors R11 and R12 and the negative input terminal of the amplifier 1011, is connected to one terminal of the capacitor C11. Another terminal of the capacitor C11 is connected to an output terminal of the amplifier 1011 and a first input terminal of a comparator 1021 in the power converter 1002. Another terminal of the resistor R16, whose one terminal is connected to the resistors R14 and R15 and the capacitor C12, is connected to a positive input terminal of the amplifier 1011 and one terminal of the resistor R17. Another terminal of the resistor R17 is connected to a positive terminal of a reference voltage source Vr. A negative terminal of the reference voltage source Vr is grounded.

The power converter 1002 is composed of a comparator 1021, triangular wave generator 1022, gate driving circuit 1023, MOSFET 1024, and choke coil 1025. As described above, the first input terminal of the comparator 1021 is connected to the output terminal of the amplifier 1011 and the capacitor C11, and a second input terminal of the comparator 1021 is connected to the triangular wave generator 1022. An output terminal of the comparator 1021 is connected to the gate driving circuit 1023, and an output terminal of the gate driving circuit 1023 is connected to the gate of the MOSFET 1024. The source of the MOSFET 1024 is grounded, and the drain thereof is connected to one terminal of the choke coil 1025 and the anode of the diode 1041 in the smoothing circuit 1004. Another terminal of the choke coil 1025 is connected to a positive terminal of the power source 1003. A negative terminal of the power source 1003 is grounded.

The smoothing circuit 1004 is composed of a diode 1041 and capacitor 1042. As described above, the anode of the diode 1041 is connected to the drain of the MOSFET 1024 and one terminal of the choke coil 1025, and the cathode thereof is connected to one terminal of the capacitor 1042 and a positive polarity side terminal of the load 1005. Another terminal of the capacitor 1042 is grounded. The positive polarity side terminal of the load 1005 is connected with the cathode of the diode 1041 and one terminal of the capacitor 1042, and a negative polarity side terminal thereof is grounded.

The controller 1000 generates a control signal u from the output voltage Vo and the reference voltage Vr of the reference voltage source. The control signal u is compared in the comparator 1021 with the output of the triangular wave generator 1022, and the output of the comparator 1021 drives the MOSFET 1024 through the gate driving circuit 1023. After being converted by the MOSFET 1024 that is turned on or off according to the output of the comparator 1021, and the choke coil 1025, and being smoothed by the smoothing circuit 1004, the input voltage of the power source 1003 is output to the load 1005 as the output voltage Vo.

Here, the transfer function of the controller 1000 is as follows:

$$\frac{b_2 s^2 + b_1 s + b_0}{s(s + a_1)} \tag{1}$$

Incidentally, each coefficient b0, b1, b2, and a is represented as follows:

$$a_1 = \frac{1}{C_{12}}\left(\frac{1}{R_{14}} + \frac{1}{R_{15}} + \frac{1}{R_{16}+R_{17}}\right)$$

$$b_0 = \frac{1}{C_{11}C_{12}R_{11}}\left(\frac{1}{R_{14}} + \frac{1}{R_{15}} + \frac{1}{R_{16}+R_{17}}\right) - \frac{R_{17}}{C_{11}C_{12}R_{14}(R_{16}+R_{17})}\left(\frac{1}{R_{11}} + \frac{1}{R_{12}}\right)$$

$$b_1 = \frac{1}{C_{11}R_{11}} + \frac{R_{13}}{C_{12}R_{11}}\left(\frac{1}{R_{14}} + \frac{1}{R_{15}} + \frac{1}{R_{16}+R_{17}}\right) - \frac{R_{17}}{C_{12}R_{14}(R_{16}+R_{17})}\left\{\left(\frac{1}{R_{11}} + \frac{1}{R_{12}}\right)R_{13} + 1\right\}$$

$$b_2 = \frac{R_{13}}{R_{11}}$$

The feature of this power supply apparatus is that the root of the numerator of the equation (1) is an imaginary number, and it is said that the stable control is enabled by raising the phase up to a prescribed range at a frequency at which the gain is smallest. However, since a lot of resistors and capacitors exist in the circuit shown in FIG. 19, there is a problem that it is difficult to determine each circuit constant while making the root of the numerator of the equation (1) an imaginary number, and the circuit design cannot be easily carried out. Incidentally, a related patent of this patent is U.S. Pat. No. 5,583,752.

Thus, in the background art, the power supply apparatus enabling the high speed response with a little number of circuit constant settings was not able to be achieved.

SUMMARY OF THE INVENTION

Therefore, an object of this invention is to provide a power supply apparatus enabling the high speed response with stability, and making its design easier.

An power supply apparatus according to a first aspect of this invention comprises a power converter circuit for converting an input voltage from an input direct current power supply; an LC filter for smoothing an output of the power converter circuit and supplying the smoothed output to a load; and a controller for controlling the power converter circuit based on an output voltage of the LC filter. A transfer function G of the controller is represented by a following equation, in which a root of its numerator is a real number.

$$\frac{N_2 s^2 + N_1 s + N_0}{s^2 + D_1 s + D_0} \tag{2}$$

N0, N1, N2, D0 and D1 are coefficients. Moreover, a loop transfer function calculated by a transfer function of the power converter circuit, a transfer function of the LC filter and the load, and the transfer function G of the controller has an open loop characteristic that a gain margin is omitted.

It has been assumed in a conventional established theory that a stable power supply apparatus cannot be obtained if the gain margin and phase margin are not secured. However, according to a new and unobvious finding by the inventors of the present application, the following matter has been derived. That is, in at least a case where the transfer function G of the controller is represented by the equation (2) and the root of the numerator thereof is a real number, there is no problem as for the stability even if the gain margin is not secured. Moreover, if the transfer function G represented by the equation (2), in which the root of the numerator thereof is a real number, is adopted, a design also becomes easy, since the number of circuit constants has decreased. In addition, when the transfer function G is determined so as not to secure the gain margin, a power supply apparatus with the high speed response is achieved.

An power supply apparatus according to a second aspect of the invention comprises a power converter circuit for converting an input voltage from an input direct current power supply; an LC filter for smoothing an output of the power converter circuit and supplying the smoothed output to a load; and a controller for controlling the power converter circuit based on an output voltage of the LC filter. A transfer function G of the controller is represented by the equation (2), in which a root of its numerator is a real number. In addition, a loop transfer function including a transfer function of the power converter circuit, the LC filter, and the load, and the transfer function G of the controller has an open loop characteristic that only a phase margin is secured among the phase margin and a gain margin.

An power supply apparatus according to a third aspect of the invention comprises a power converter circuit for converting an input voltage from an input direct current power supply; an LC filter for smoothing an output of the power converter circuit and supplying the smoothed output to a load; and a controller for controlling the power converter circuit based on an output voltage of the LC filter. A transfer function G of the controller is represented by the equation (2), in which a root of its numerator is a real number. In addition, a loop transfer function including a transfer function of the power converter circuit, the LC filter, and the load, and the transfer function G of the controller has an open loop characteristic that a gain exceeds 0 dB at a frequency at which a phase becomes −180 degrees.

Incidentally, the frequency at which the phase becomes −180 degrees may be set in a frequency range from the resonance frequency of the LC filter to the gain crossover frequency. Conventionally, to give the gain margin, the phase-lead compensation was carried out to the phase delay caused by the LC filter. However, the gain margin need not be secured according to a new and unobvious finding by the inventors of this application as described above. Therefore, in the third aspect of this invention, in the frequency range from the resonance frequency of the LC filter to the gain crossover frequency (that is, a frequency from which the gain is equal to or lower than 0 dB), a phase may be −180 degrees or less. In that frequency range, a high-speed response is realized by being in the state in which the gain exceeds 0 dB without lowering it greatly.

An power supply apparatus according to a fourth aspect of this invention comprises a power converter circuit for converting an input voltage from an input direct current power supply; an LC filter for smoothing an output of the power converter circuit and supplying the smoothed output to a load; and a controller for controlling the power converter circuit based on an output voltage of the LC filter. A transfer function G of the controller is represented by the equation (2), in which a root of its numerator is a real number. In addition, a loop transfer function including a transfer function of the power converter circuit, the LC filter, and the load, and the transfer function G of the controller has an open loop characteristic that a gain exceeds 0 dB at a frequency at which a phase is mostly delayed.

As described above, when the phase-lead compensation is not performed at all, or when there is little compensation, the phase will be long-overdue with phase delay due to the LC filter. The high speed response is achieved by adopting such a structure that the frequency range is provided in which the phase has the maximum delay because of the phase delay of the LC filter, and the gain exceeds 0 dB in that frequency range. Incidentally, the frequency with the maximum phase delay may be set in the frequency range from the resonance frequency of the LC filter to the gain crossover frequency.

An power supply apparatus according to a fifth aspect of this invention comprises a power converter circuit for converting an input voltage from an input direct current power supply; an LC filter for smoothing an output of the power converter circuit and supplying the smoothed output to a load; and a controller for controlling the power converter circuit based on an output voltage of the LC filter. The controller has a PID control function whose transfer function G is represented by the equation (2), in which a root of its numerator is a real number. In addition, at frequencies higher than the resonance frequency of the LC filter, an integral control element is applied.

Thus, by applying an integral-control element also in a frequency band higher than the resonance frequency of the LC filter, a predetermined frequency band containing a most phase overdue frequency (i.e. a frequency range containing a frequency at which the phase is mostly delayed) is generated, and the gain comes to decrease suddenly based on the property of the low pass filter by the LC filter and the property of the integral-control element. That a gain curve becomes strong makes high gain realize in the aforementioned predetermined frequency band, and it can realize, as a result, the structure, which can carry out a high-speed response also to a sudden change of the load.

In addition, the controller may apply the differential control element at frequencies that are lower than the gain crossover frequency.

Incidentally, though specific examples will be explained later, there are a lot of circuits, that can achieve the aforementioned transfer function G in the first to fifth aspects of this invention, and any of those can be used.

DETAILED DESCRIPTION OF THE PREFERRED EMBODIMENTS

1. First Embodiment

Figure 1:
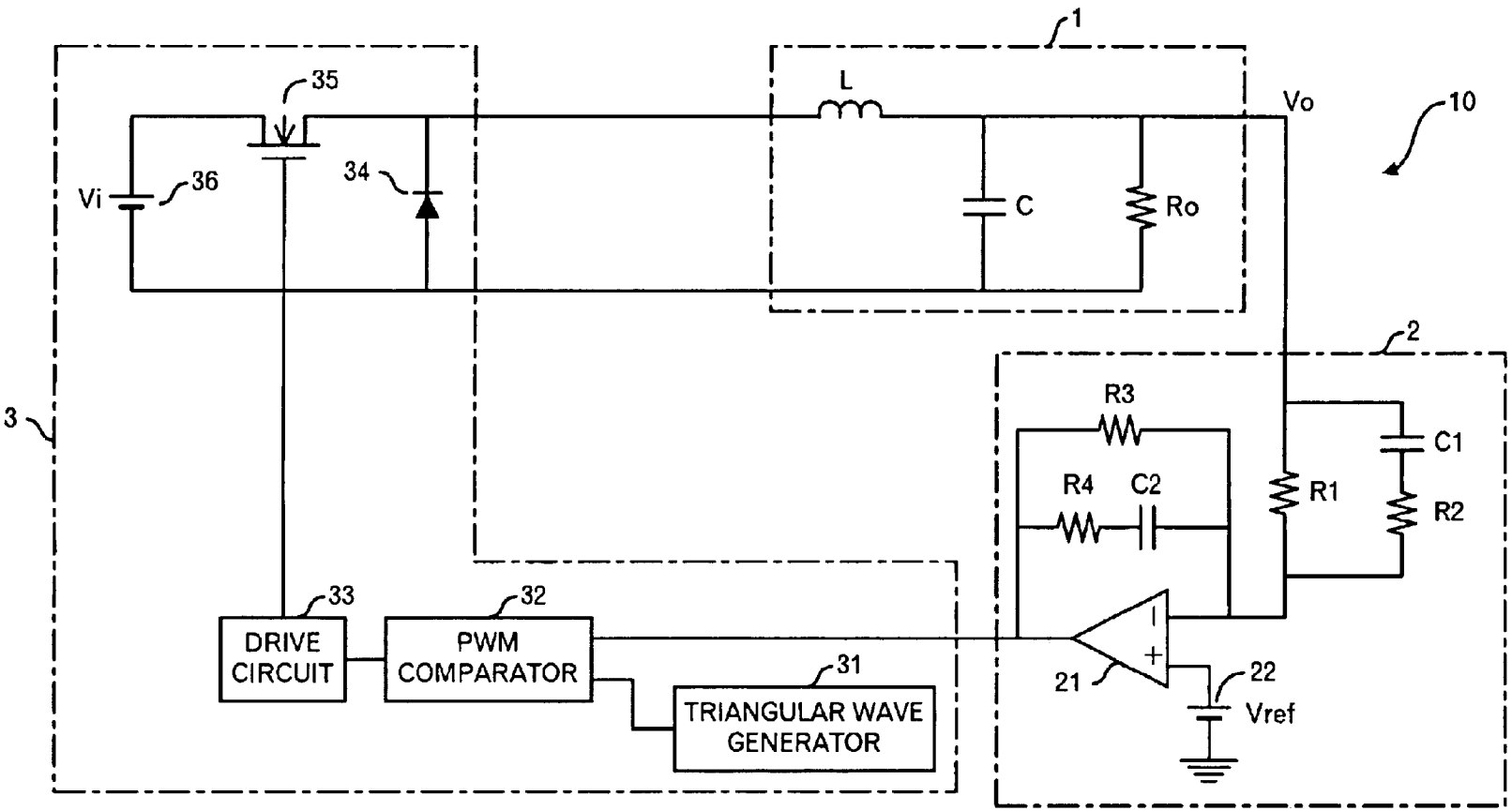
FIG. 1 is a diagram showing the circuit structure of a power supply apparatus in the first embodiment of this invention.

FIG. 1 shows the circuit structure of a power supply apparatus 10 according to the first embodiment of this invention. The power supply apparatus 10 is a power supply apparatus of a step-down type, and it is composed of a LC filter 1, controller 2 that is a PID controller, and power converter 3.

The controller 2 includes resistors R1 to R4, capacitors C1 and C2, an amplifier 21, and a reference voltage power supply 22. The resistor R1 and capacitor C1 are connected to a positive terminal of a load Ro in the LC filter 1. That is, an output voltage Vo is input to the controller 2. The capacitor C1 and resistor R2 are connected in series, and the capacitor C1 and resistor R2 are connected to the resistor R1 in parallel. Therefore, one terminal of the resistor R1 whose another terminal connects to the capacitor C1 is connected with the resistor R2. Moreover, the resistor R1 and R2 are connected to a negative input terminal (i.e. an inversion input terminal) of the amplifier 21, and are further connected to the resistor R3 and capacitor C2. The capacitor C2 and resistor R4 are connected in series, and the capacitor C2 and resistor R4 are connected to the resistor R3 in parallel. Therefore, one terminal of the resistor R3 whose another terminal connects to the capacitor C2 is connected to the resistor R4. Moreover, the resistors R3 and R4 are connected to an output terminal of the amplifier 21. A positive input terminal (a non-inversion input terminal) of the amplifier 21 is connected to a positive polarity side terminal of the reference voltage power supply 22, and a negative polarity side terminal of the reference voltage power supply 22 is grounded.

The power converter 3 is composed of a triangular wave generator 31, PWM comparator 32, drive circuit 33, diode 34, MOSFET 35, and input power source 36. A first input terminal of the PWM comparator 32 is connected to the output terminal of the amplifier 21 in the controller 2, and a second input terminal thereof is connected to the triangular wave generator 31. An output of the PWM comparator 32 is connected to the drive circuit 33. An output of the drive circuit 33 is connected to the gate of the MOSFET 35. The drain of the MOSFET 35 is connected with a positive polarity side terminal of an input power source 36, and the source thereof is connected to the cathode of the diode 34 and a choke coil L. A negative polarity side terminal of the input power source 36 is connected to the anode of the diode 34, capacitor C, and a negative polarity side terminal of the load Ro.

The LC filter 1 includes a choke coil L, capacitor C, and load Ro. One terminal of the choke coil L whose another terminal is connected to the source of MOSFET 35 and the cathode of the diode 34 is connected with the capacitor C and the positive polarity side terminal of the load Ro. As stated above, one terminal of the capacitor C whose another terminal is connected to the choke coil L and the positive polarity side terminal of the load Ro is connected to the negative polarity side terminal of the load Ro, the anode of the diode 34, and the negative polarity side terminal of the input power source 36.

Next, an operation of the power supply apparatus 10 shown in FIG. 1 is briefly explained. The controller 2 generates a control signal based on the output voltage Vo that appears at the load Ro and the reference voltage Vref. This control signal is compared in the PWM comparator 32 with the triangular wave signal output from the triangular wave generator 31, and the PMW comparator 32 outputs a signal having a pulse width corresponding to the voltage of the control signal. The output signal of the PWM comparator 32 turns on or off the MOSFET 35 through the drive circuit 33. The input voltage Vi of the input power source 36 is converted according to on or off of the MOSFET 35, and is smoothed by the diode 34 and the LC filter composed of the choke coil L and the capacitor C, and the smoothed output is output to the load Ro as the output voltage Vo. As a result, a stable control is carried out so as to match the output voltage Vo to the reference voltage Vref.

The transfer function G of the controller 2 shown in FIG. 1 is represented as follows:

$$\frac{N_2 s^2 + N_1 s + N_0}{s^2 + D_1 s + D_0} \tag{2}$$

However, N0, N1, N2, D0, and D1 are coefficients, and the relationship between the coefficients and the resistors R1 to R4 and capacitors C1 and C2 is as follows:

$$N_0 = \frac{R3}{R1R2C1C2(R3+R4)}$$

$$N_1 = \frac{R3(R1C1+R2C1+R4C2)}{R1R2C1C2(R3+R4)}$$

$$N_2 = \frac{R3R4(R1+R2)}{R1R2(R3+R4)}$$

$$D_0 = \frac{1}{R2C1C2(R3+R4)}$$

$$D_1 = \frac{C2(R3+R4)+R2C1}{R2C1C2(R3+R4)}$$

Figures 2, 3, 4:
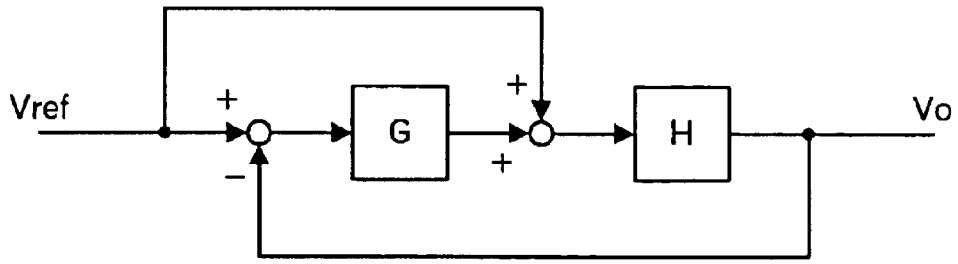
FIG. 2 is a circuit constant table for a controller in the first embodiment of this invention.
FIG. 3 is a table showing the circuit constants for circuits 10 and 20 in the first and second embodiments of this invention.
FIG. 4 is a diagram showing a block diagram in the first and second embodiments of this invention.

More specifically, the circuit constants like a table shown in FIG. 2 are used. That is, R1=1 kΩ, R2=98Ω, R3=710 kΩ, R4=2.2 kΩ, C1=2.2 nF, and C2=1 nF. Then, the equation (2) becomes as follows:

$$\frac{24.57s^2 + 2.134\times10^7 s + 4.624\times10^{12}}{s^2 + 4.670\times10^6 s + 6.513\times10^9} \tag{3}$$

The roots of the numerator of the equation (3) are $-4.541\times10^5$ and $-4.144\times10^5$, and are not imaginary numbers but real numbers.

Incidentally, FIG. 3 shows the specification and other parameters of the power supply apparatus 10. That is, the input voltage Vi=6V, the output voltage Vo=2.5V, the output current Io=1 A (maximum) , a reactance L of the choke coil L=3 μH, a capacitance C of the capacitor C=9.4 μF, the load Ro=2.5Ω, the reference voltage Vref=2.5V, and a gain Kp of the power converter circuit=10 times.

FIG. 4 shows a block diagram of the power supply apparatus 10 shown in FIG. 1. That is, the output voltage Vo is negatively fedback, and is subtracted from the reference voltage Vref, and the calculation result (Vref−Vo) is input to the transfer function G of the controller 2. An output of this transfer function G is added to the feed forward command voltage Vref, and the addition result is input to the transfer function H of a circuit to be controlled, and an output of the transfer function H is the output voltage Vo. The transfer function G is represented by the aforementioned equation (2). In this embodiment, it is assumed that the transfer function H of the circuit to be controlled is as follows:

$$\frac{\frac{1}{LC}Kp}{s^2 + \frac{1}{CRo}s + \frac{1}{LC}} \tag{4}$$

This transfer function H is a transfer function of the LC filter 1 and power converter 3. When the numerical values described in FIG. 3 is substituted, the transfer function H becomes as follows:

$$\frac{3.546\times10^{11}}{s^2 + 4.255\times10^4 s + 3.546\times10^{10}} \tag{5}$$

The loop transfer function is calculated by multiplying the equation (2) and equation (4). More specifically, it is calculated by multiplying the equation (3) and equation (5).

Incidentally, when modeling of the candidates for control is strictly carried out in the power supply apparatus 10, the switching delay and other delay elements of the MOSFET 35, which are contained in the power converter 3, also exist. However, the strict modeling is difficult, and its switching delay of MOSFET 35 and the like is indefinite as to how much it is. In the subsequent explanation, an example at the time of modeling the LC filter 1 and the power converter 3 as the candidates for control is disclosed. This is because the delay of the LC filter 1 is very large as compared with other delay elements and the power converter 3 has a big gain, which cannot be disregarded.

Figure 5:
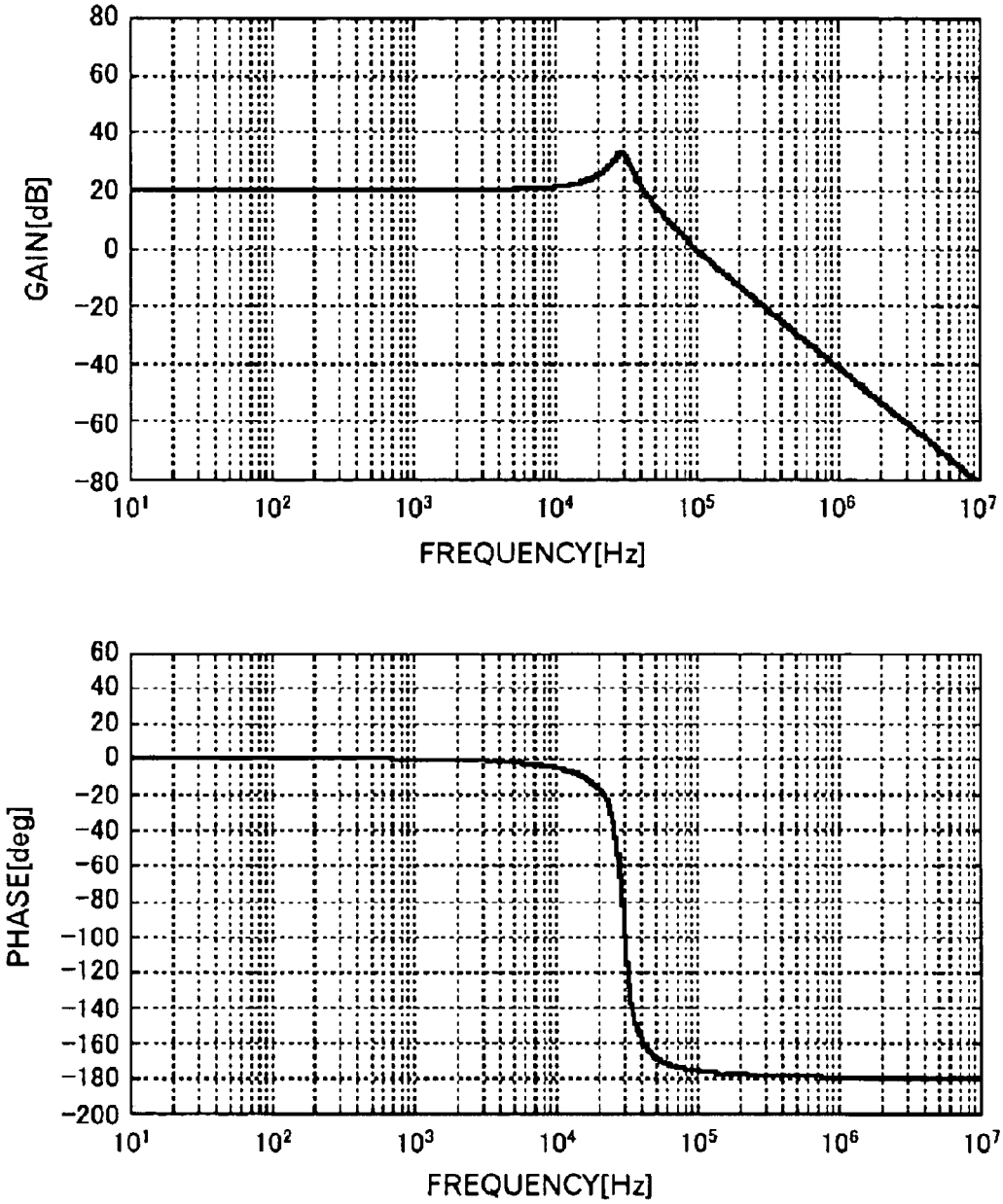
FIG. 5 is a Bode diagram of a transfer function of a LC filter and power converter to be controlled in the first embodiment of this invention.
Figure 6:
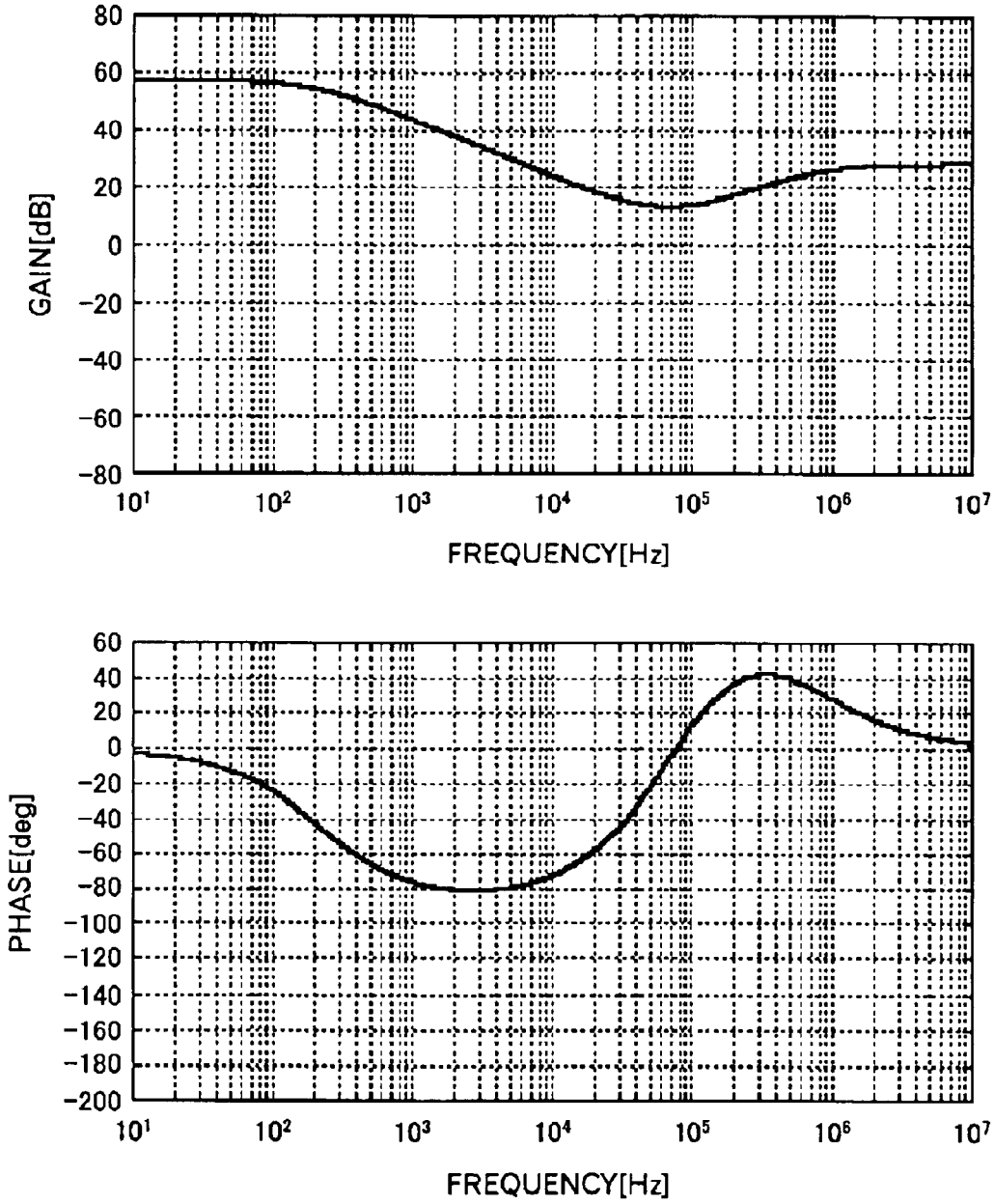
FIG. 6 is a Bode diagram of a transfer function of the controller in the first embodiment of this invention.

The Bode diagram of the circuit to be controlled, which is based on the equation (5), is shown in FIG. 5. In FIG. 5, the frequency characteristic of the gain is shown in the upper diagram, and the frequency characteristic of the phase is shown in the lower diagram. In FIG. 5, the resonance frequency of the LC filter 1 is about $3\times10^4$ Hz. In addition, there is a peak of the gain at the resonance frequency. Furthermore, the phase begins its delay at a frequency that is lower than the resonance frequency, and sharply delays at the resonance frequency, and finally delays up to −180 degrees. The Bode diagram of the controller 2, which is based on the equation (3), is shown in FIG. 6. Also in FIG. 6, the frequency characteristic of the gain is shown in the upper diagram, and the frequency characteristic of the phase is shown in the lower diagram. In FIG. 6, the gain is 57 dB up to about $5\times10^1$ Hz, and is horizontal, but it decreases from about $5\times10^1$ Hz to about $7\times10^4$ Hz almost linearly. In the higher frequency range than that, it rises a little. As for the phase, the phase delay of about −80 degrees occurs up to about $2\times10^3$ Hz, and in the higher frequency range than that, it leads up to +40 degrees up to about $3\times10^5$ Hz. The phase delay occurs again up to about 0 degree in the further higher frequency range.

Figure 7:
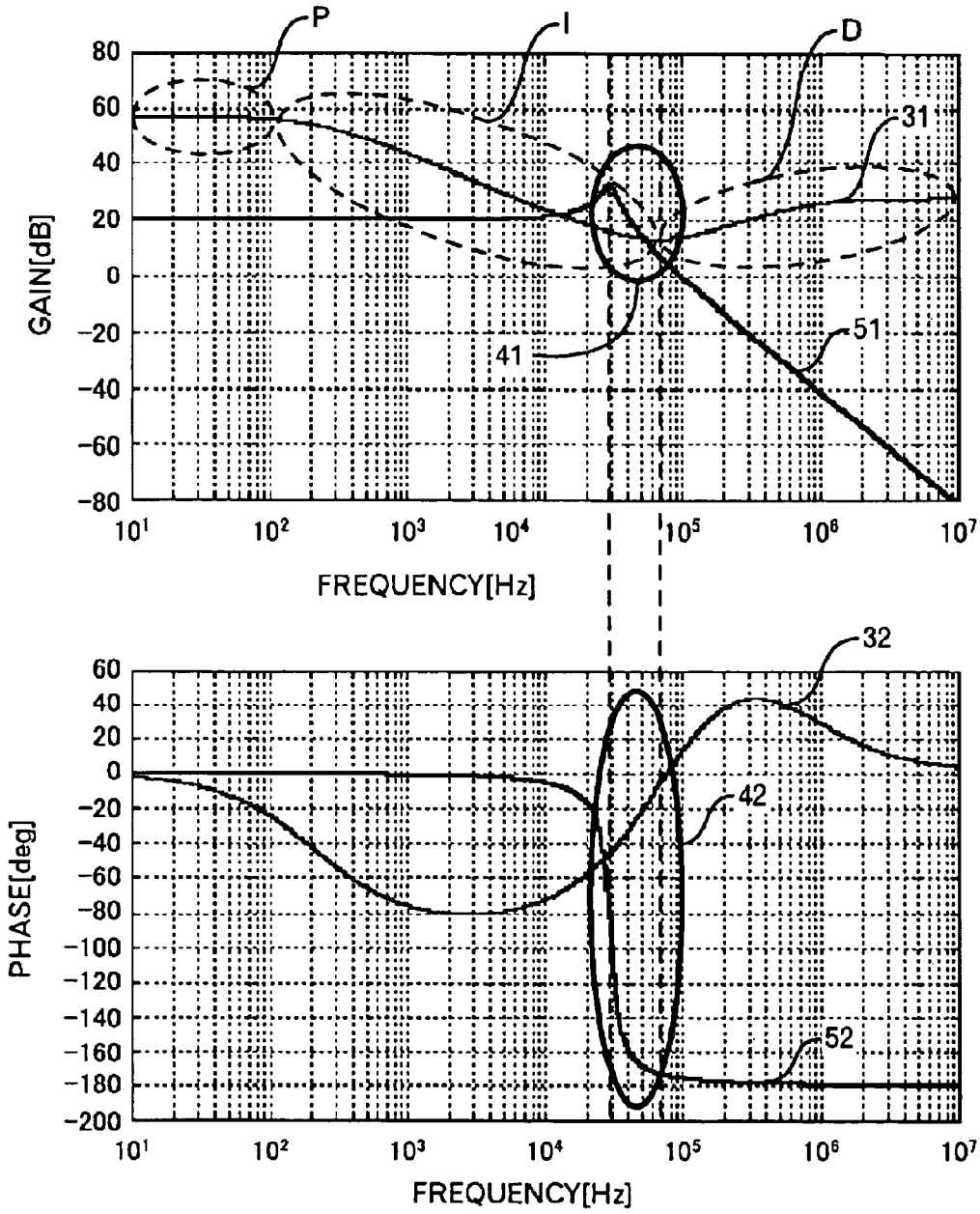
FIG. 7 is a diagram in which a Bode diagram of the transfer function of the LC filter and the power converter to be controlled is placed on a Bode diagram of the transfer function of the controller in the first embodiment of this invention.

The Bode diagram placing the Bode diagram of FIG. 5 and the Bode diagram of FIG. 6 is shown in FIG. 7. The frequency characteristic of the gain is shown in the upper diagram, a curve 51 represents the gain frequency characteristic of the equation (5), and a curve 31 represents the gain frequency characteristic of the equation (3). In this embodiment, the feature is to apply the integral (I) element, which was applied from the low frequency range to remove the steady-state deviation, to a frequency range that is higher than the resonance frequency of the LC filter 1. In FIG. 7, it is a circle 41 shown by the solid line. Moreover, the lower diagram of FIG. 7 shows the frequency characteristic of the phase, and a curve 52 represents the phase frequency characteristic of the equation (5), and a curve 32 represents the phase frequency characteristic of the equation (3). A circle 42 shown by the solid line corresponds to the circle 41 in the gain frequency characteristic. When the curve 52 and curve 32 are added to calculate the phase frequency characteristic of the loop transfer function, the frequency range with the maximum phase delay (Hereafter, it is called the trap point) appears. Incidentally, the differential (D) control element of the PID control element is applied from a frequency that is lower than the gain crossover frequency.

Figures 8, 9:
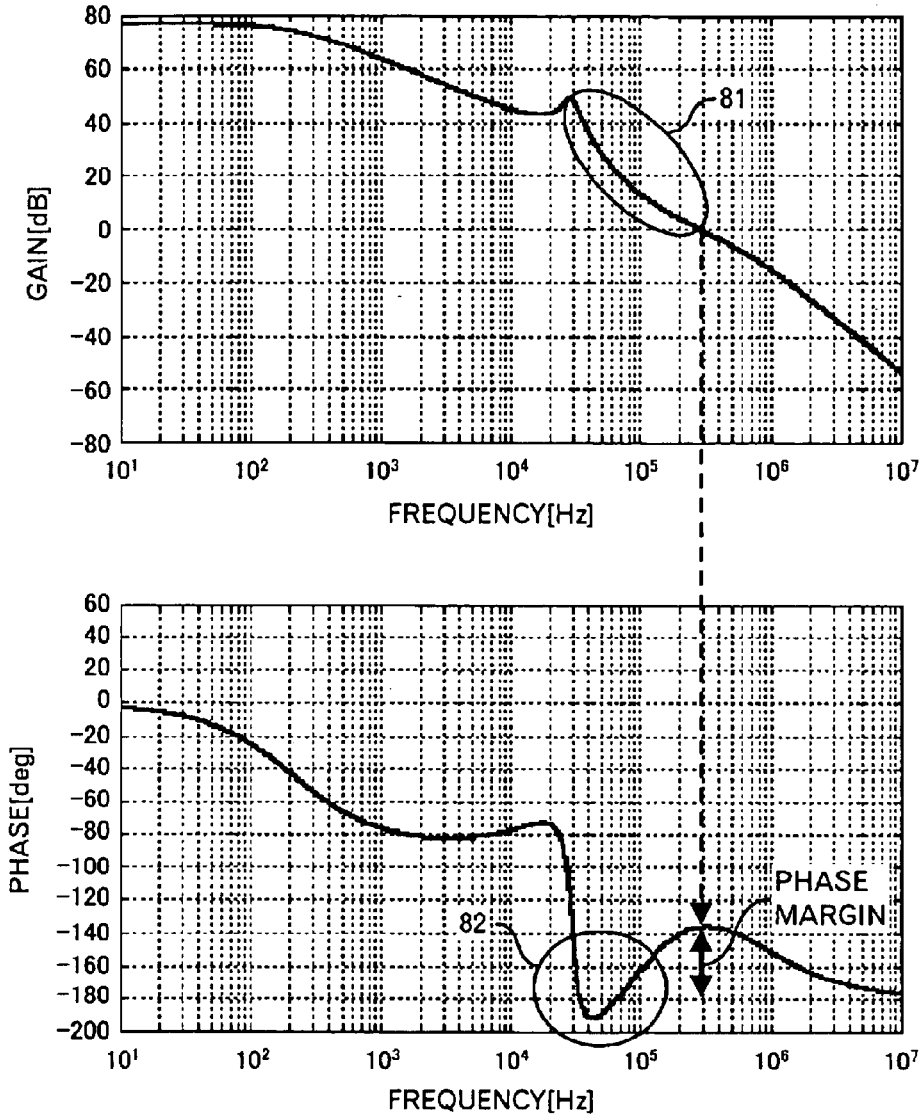
FIG. 8 is a Bode diagram of a loop transfer function in the first embodiment of this invention.
FIG. 9 is a table showing circuit constants of a conventional controller.

The Bode diagram of the loop transfer function is shown in FIG. 8. The upper diagram shows the gain frequency characteristic of the loop transfer function in which the gain characteristics of FIG. 5 and FIG. 6 are synthesized, and the lower diagram shows the phase frequency characteristic of the loop transfer function in which the phase frequency characteristics of FIG. 5 and FIG. 6 are synthesized. As shown in FIG. 7, by applying the integral (I) element of the PID to a frequency range that is higher than the resonance frequency of the LC filter 1, a part 81, in which the slope of the gain frequency characteristic increases, appears. Moreover, the trap point 82 including the frequency with the maximum phase delay appears at the same frequency range as the part 81. The phase becomes less than −180 degrees in this frequency range, and the gain in that range exceeds 0 dB. That is, there is no gain margin. Though this is not permitted from the conventional concept of the stability, in this embodiment, there is no problem since it stably works even if there is no gain margin. On the other hand, the phase margin at the gain crossover frequency, at which the gain becomes 0 dB, is about 45 degrees. Therefore, an enough phase margin is secured. As a result, the stable operation is secured. Incidentally, the trap point 82 is generated by applying the Integration (I) control element to a frequency band higher than the resonance frequency of the LC filter 1 in addition to the characteristic in which the phase delay of −180 degrees occurs at the resonance frequency of the LC filter 1. Therefore, the frequency with the maximum phase delay becomes a frequency higher than the resonance frequency of the LC filter 1. On the other hand, the phase leads at frequencies that are higher than the trap point 82, and it has almost a relative maximum value at the gain crossover frequency. Therefore, the gain crossover frequency becomes a frequency that is higher than the frequency with the maximum phase delay.

When the frequency range at which the phase is sharply delayed like this is generated, the gain decreases sharply in that frequency range as shown in the part 81 of FIG. 8. The high gain can be achieved by making this high slope of the gain even in a limited frequency range, and a mechanism that the high speed response becomes possible when the load changes suddenly is achieved as a result.

Moreover, the number of resistors used for the controller 2 is 4, and the number of capacitors is 2. The number of resistors may be 3 as described later. Therefore, this embodiment also has an advantage that the circuit design is easy, since the number of parameters that should be determined to compose the circuit for achieving the aforementioned frequency characteristic of the gain and the phase is relatively small.

Here, a design example which secures both of the phase margin and the gain margin without changing the circuit shown in FIG. 1 and the specification of the power supply (FIG. 3) is shown in FIG. 9. That is, R1=1 kΩ, R2=25Ω, R3=70 kΩ, R4=550Ω, C1=10 nF, and C2=14 nF. The transfer function of the controller 2 is as follows in a case of such a circuit constant setting:

$$\frac{22.3s^2 + 5.09\times10^6 s + 2.835\times10^{11}}{s^2 + 4.001\times10^6 s + 4.05\times10^9} \tag{6}$$

The roots of the numerator of the equation (6) are $-1.318\times10^5$ and $-9.647\times10^4$.

Figure 10:
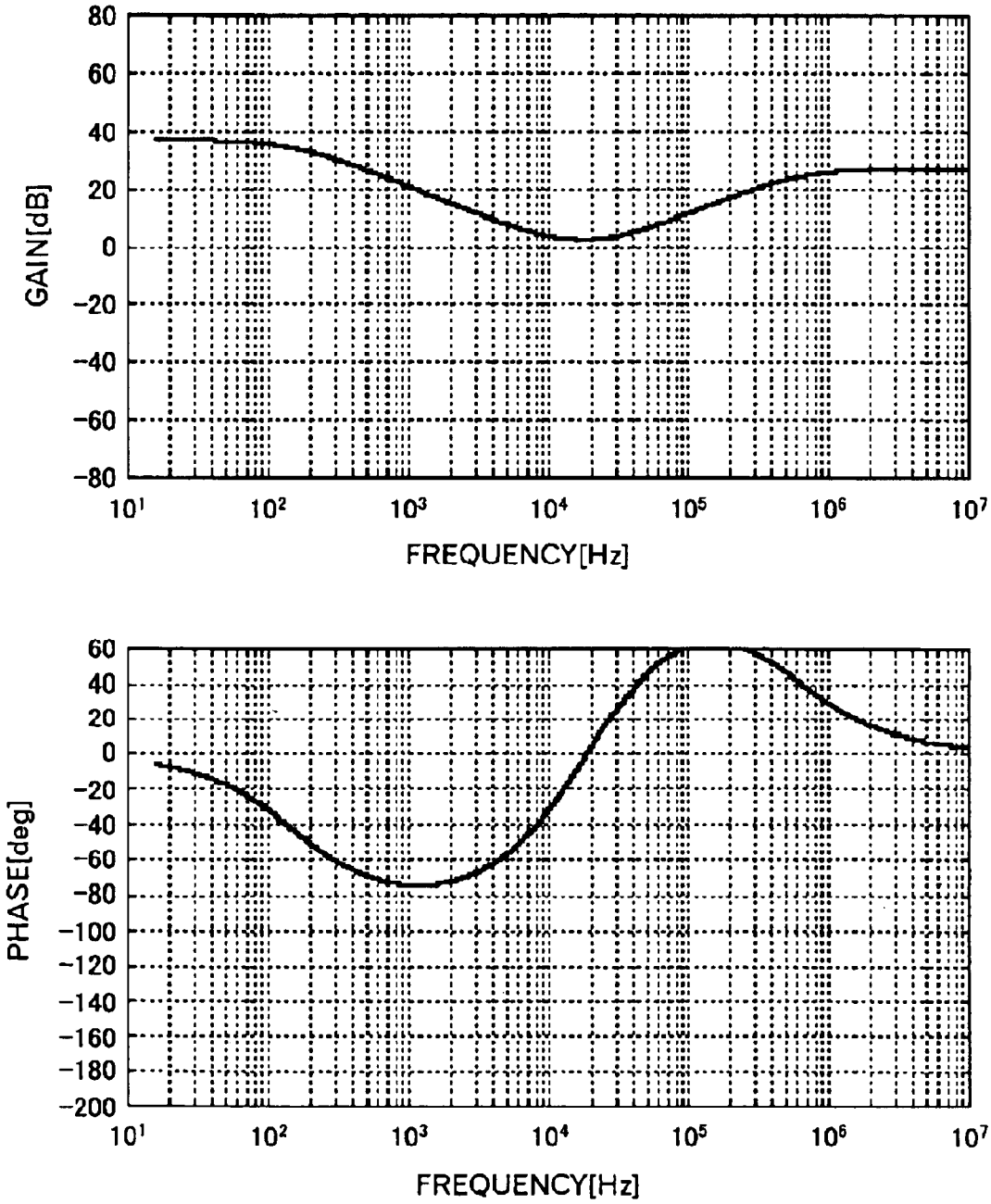
FIG. 10 is a Bode diagram showing the transfer function of the conventional controller.
Figure 18:
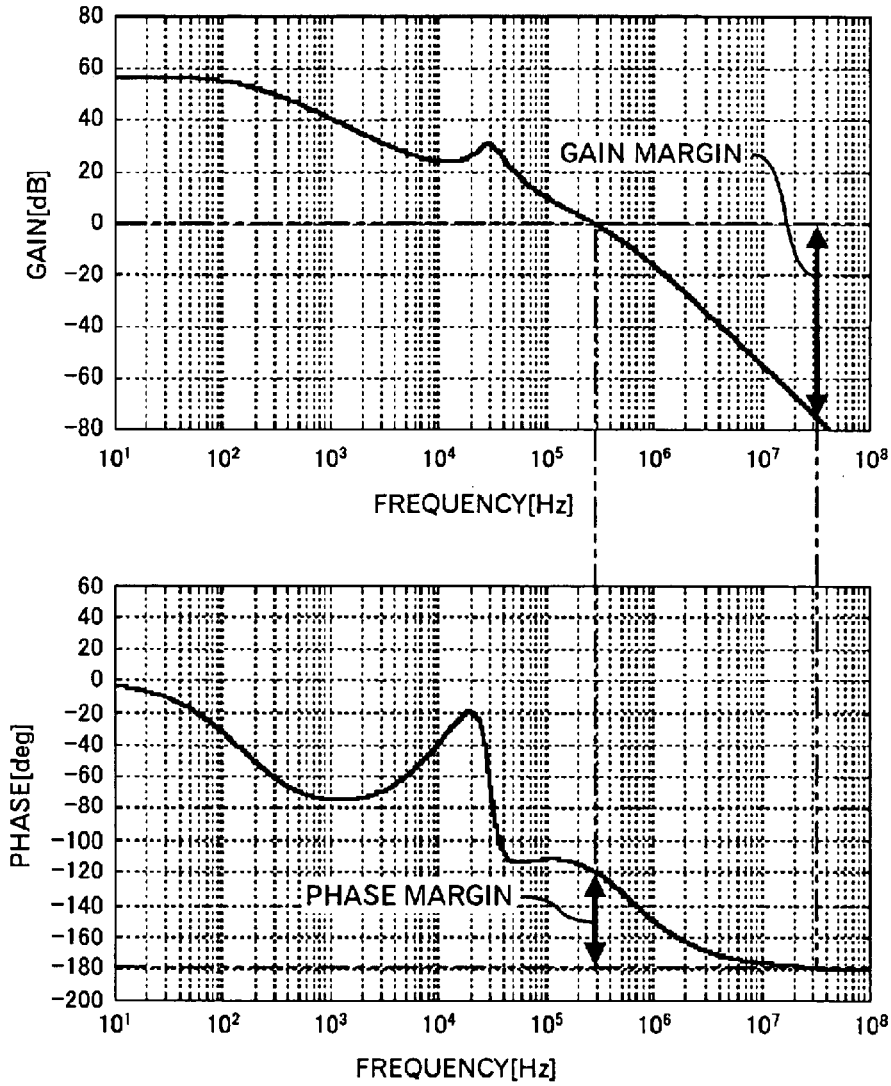
FIG.18 PRIOR ART
FIG. 18 is a diagram showing a Bode diagram of a loop transfer function in the conventional technique.

The Bode diagram of the transfer function of the controller 2 represented by the equation (6) is shown in FIG. 10. The frequency characteristic of the gain is shown in the upper diagram, and the frequency characteristic of the phase is shown in the lower diagram. Different from the Bode diagram of the transfer function of the controller 2 represented by the equation (3) in FIG. 6, the application of the integral (I) element of the PID is terminated at about $2\times10^4$ Hz that is a frequency lower than the resonance frequency of the LC filter 1. According to that, the phase begins to lead from the low frequency range, and the frequency, at which the phase lead becomes the relative maximum, is also lowered. Therefore, the Bode diagram of the loop transfer function calculated by multiplying the equation (5) and equation (6) becomes a diagram as shown in FIG. 18. As shown in the lower diagram of FIG. 18, the phase delays from about 20 Hz to about 1 kHz, but leads up to about −20 degrees before reaching the resonance frequency. Then, a large delay occurs at the vicinity of the resonance frequency, but the phase does not delay up to −180 degrees because of the application of the differential (D) element of the PID. Therefore, the phase does not become −180 degrees or less in the frequency range in which the gain exceeds 0 dB. Though a frequency, at which the phase becomes the relative minimum, exists, it is not the frequency with the maximum phase delay. And, the phase margin of about 60 degrees is secured at the gain crossover frequency at which the gain becomes 0 dB. The phase delays further in a further higher frequency range, and when it becomes −180 degrees at about $1\times10^7$ Hz, the gain has a negative value. Therefore, the gain margin is also secured. The gain frequency characteristic does not show a sharp decrease of the gain like FIG. 8, but the gain decreases gently. Therefore, the high speed response is inferior though the stability is secured as said hitherto. On the other hand, in this embodiment as described above, by applying the integral (I) element of the PID to a frequency range that is higher than the resonance frequency of the LC filter 1, the trap point is generated in the phase frequency characteristic, and a high slope of the gain is achieved in the gain frequency characteristic. The gain margin is disregarded though the phase margin is secured for the stability, and the high speed response can be achieved by achieving the aforementioned frequency characteristic of the gain and the phase.

2. Second Embodiment

Figure 11:
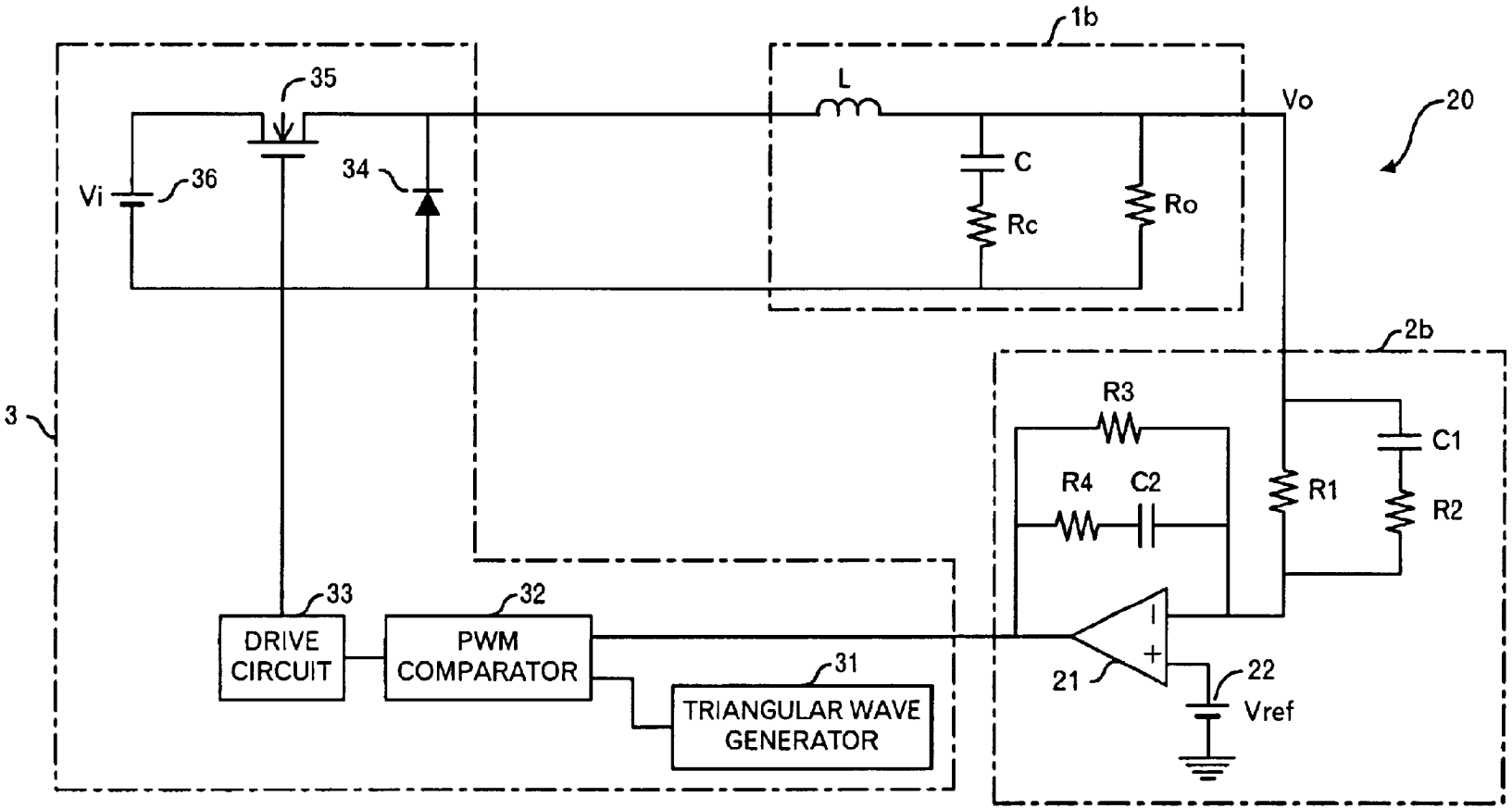
FIG. 11 is a diagram showing the circuit structure of a power supply apparatus in the second embodiment of this invention.
Figures 12, 13:
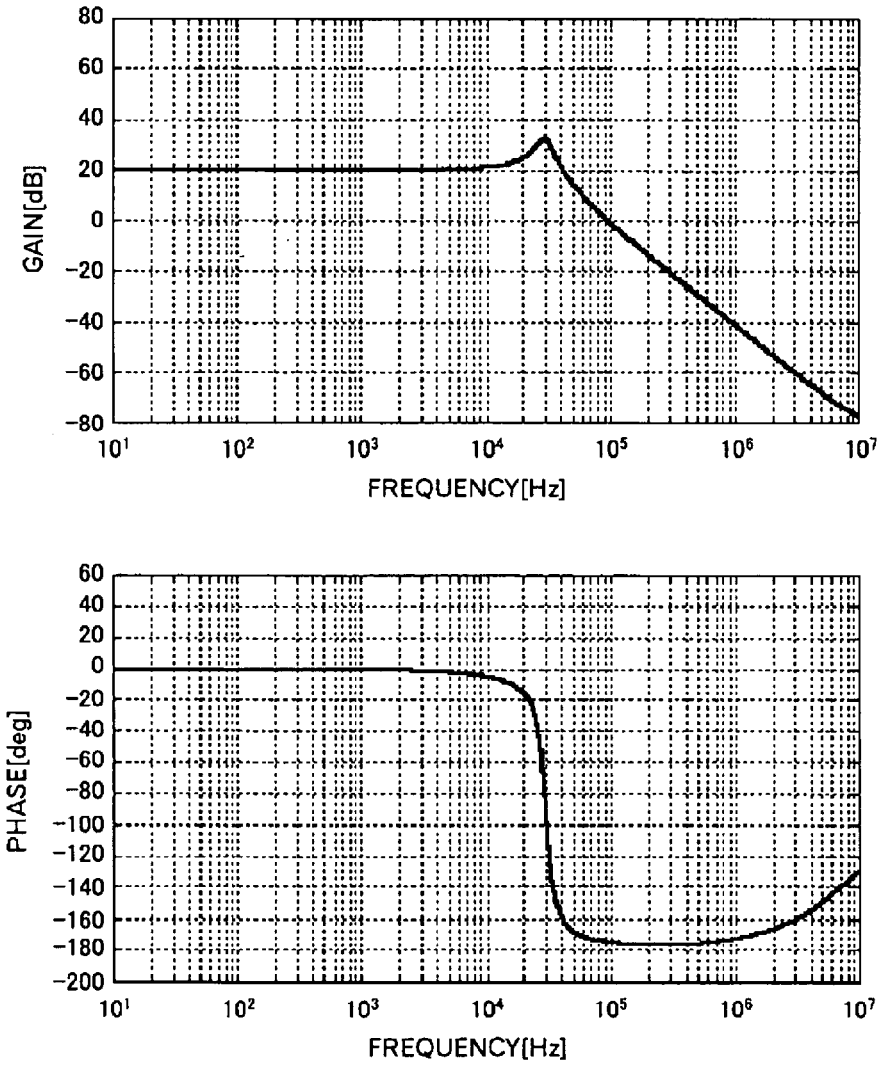
FIG. 12 is a table showing circuit constants of a controller in the second embodiment of this invention.
FIG. 13 is a Bode diagram of a transfer function of a LC filter and power converter to be controlled in the second embodiment of this invention.

The circuit structure of a power supply apparatus 20 according to this embodiment is shown in FIG. 11. The differences with the power supply apparatus 10 shown in FIG. 1 are a point in which a resistor Rc is connected to the capacitor C of the LC filter 1*b* in series, and a point in which the circuit constants of the resistors and capacitors in the controller 2*b* are changed as shown in FIG. 12. Therefore, its connection is not explained here. Incidentally, the resistor Rc is called an equivalent series resistance, and represents a resistance component included in the capacitor C. Therefore, Rc is about 2 mΩ. As explained later, the resistor Rc functions as a phase-lead compensation element in the high frequency range. The circuit constants of the resistors and the capacitors in the controller 2*b* are R1=1 kΩ, R2=60Ω, R3=430 kΩ, R4=1.4 kΩ, C1=3.3 nF, and C2=1.8 nF as shown in FIG. 12.

When the transfer function of the controller 2*b* is calculated, the following equation is obtained:

$$\frac{24.65s^2 + 1.683\times10^7 s + 2.797\times10^{12}}{s^2 + 5.052\times10^6 s + 6.504\times10^9} \tag{7}$$

In the equation (7), the roots of the numerator are $-3.968\times10^5$ and $-2.860\times10^5$. They are not imaginary but real. On the other hand, when the transfer function of the LC filter 1*b* and the power converter 3 to be controlled is calculated, the following equation is obtained:

$$\frac{\frac{RcRo}{L(Rc+Ro)}Kp\,s + \frac{Ro}{LC(Rc+Ro)}Kp}{s^2 + \left\{\frac{1}{C(Rc+Ro)} + \frac{RcRo}{L(Rc+Ro)}\right\}s + \frac{Ro}{LC(Rc+Ro)}} \tag{8}$$

$$\frac{6661.3s + 3.543\times10^{11}}{s^2 + 4.32\times10^4 s + 3.54\times10^{10}} \tag{9}$$

Figure 14:
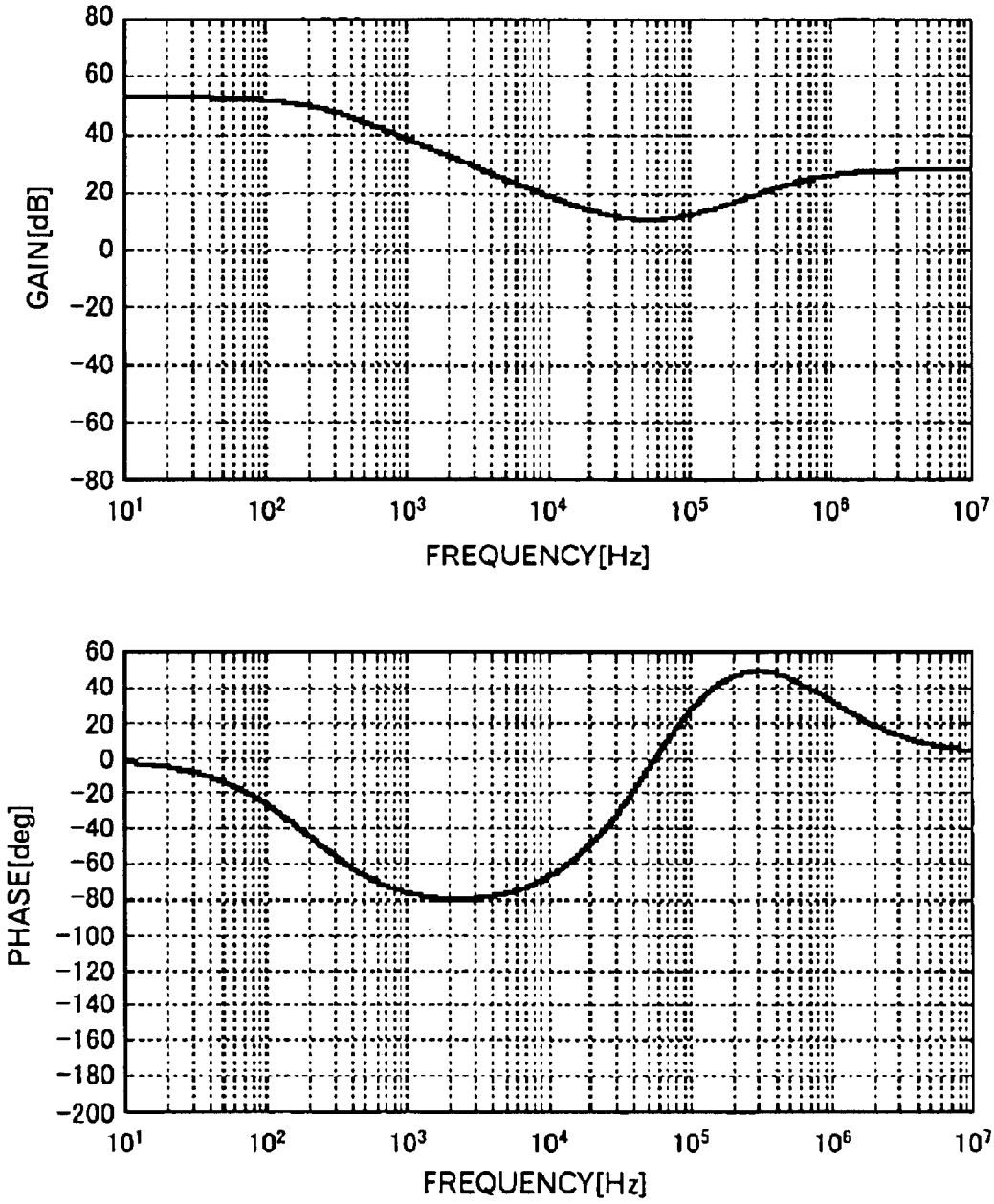
FIG. 14 is a Bode diagram of the transfer function of the controller in the second embodiment of this invention.

FIG. 13 shows the Bode diagram of the transfer function of the equation (9). As for the gain frequency characteristic shown in the upper diagram of FIG. 13, there is no large difference with the gain frequency characteristic in FIG. 5. As for the phase frequency characteristic shown in the lower diagram of FIG. 13, since the resistor Rc acts in the high frequency range as the phase-lead compensation as described above, the phase begins to lead from about $4\times10^5$ Hz gradually. On the other hand, FIG. 14 shows the Bode diagram of the transfer function of the equation (7). Compared with FIG. 6, the gain decreases in the low frequency range and the shape of the curve of the phase is different a little, but the almost similar frequency characteristic is shown in FIG. 14.

Figure 15:
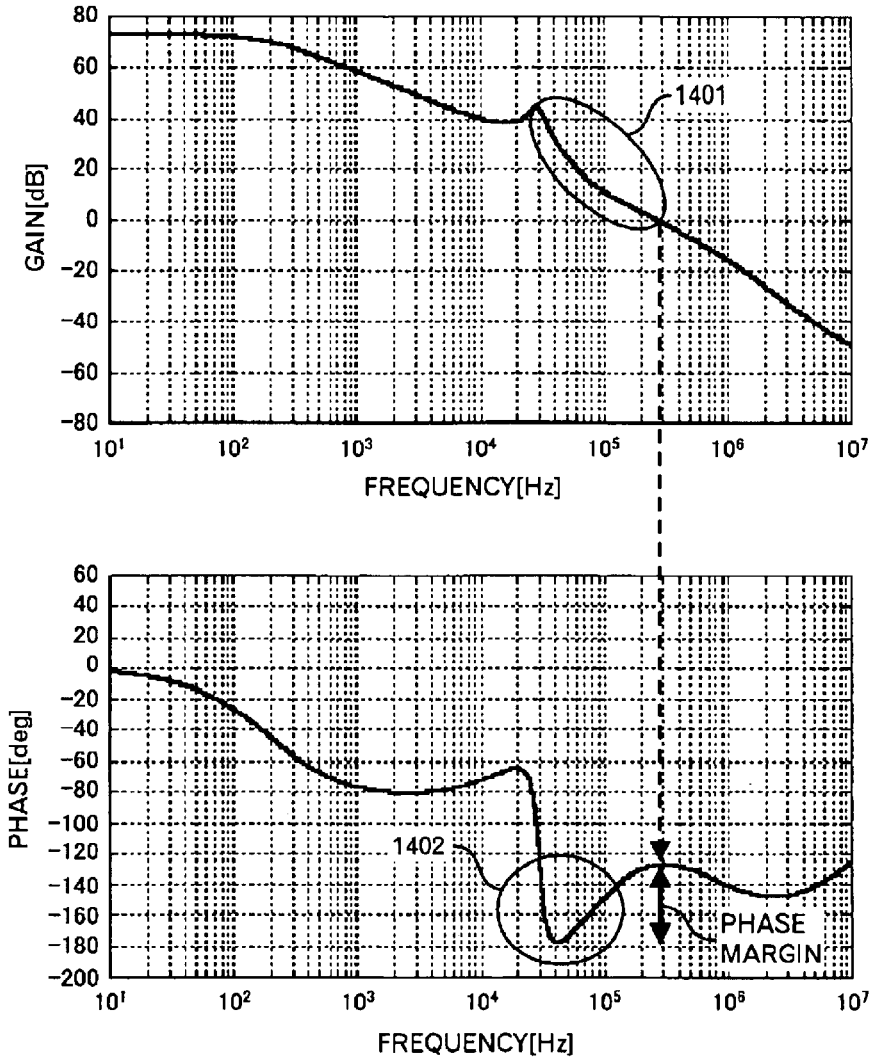
FIG. 15 is a Bode diagram of a loop transfer function in the second embodiment of this invention.

The Bode diagram of the loop transfer function, which is calculated by multiplying the transfer function of the equation (7) and the transfer function of the (9) equation, is shown in FIG. 15. In the frequency characteristic of the gain in the upper diagram of FIG. 15, a part 1401 of the frequency range that the gain decreases sharply as well as FIG. 8 appears. Moreover, in the frequency characteristic of the phase in the lower diagram of FIG. 15, a trap point 1402 including a frequency with the maximum phase delay also appears in a frequency range that is higher than the resonance frequency of the LC filter 1*b* as well as FIG. 8. However, the phase doesn't reach −180 degrees in FIG. 15 though it fell below −180 degrees at the frequency with the maximum phase delay, in FIG. 8. This is because the loop transfer function shown in FIG. 15 is calculated by multiplying the transfer function of the equation (7) and the transfer function of the equation (9), and there is a possibility where any frequency that the phase falls below −180 degrees exists if all delay elements of the power supply apparatus 20 are considered.

The gain exceeds 0 dB in the trap point 1402. Because the phase doesn't fall below −180 degrees at any frequencies higher than the trap point 1402, the gain margin is not secured. The phase leads by the differential (D) element of the PID at frequencies higher than the frequency with the maximum phase delay, and at the gain crossover frequency at which the gain becomes 0 dB, the phase margin of about 50 degrees is secured. At frequencies higher than the gain crossover frequency, though the phase delays again according to the transfer function of the controller 2*b*, it begins to lead from about $2\times10^6$ Hz since the phase-lead compensation of the resistor Rc acts.

Figure 19:
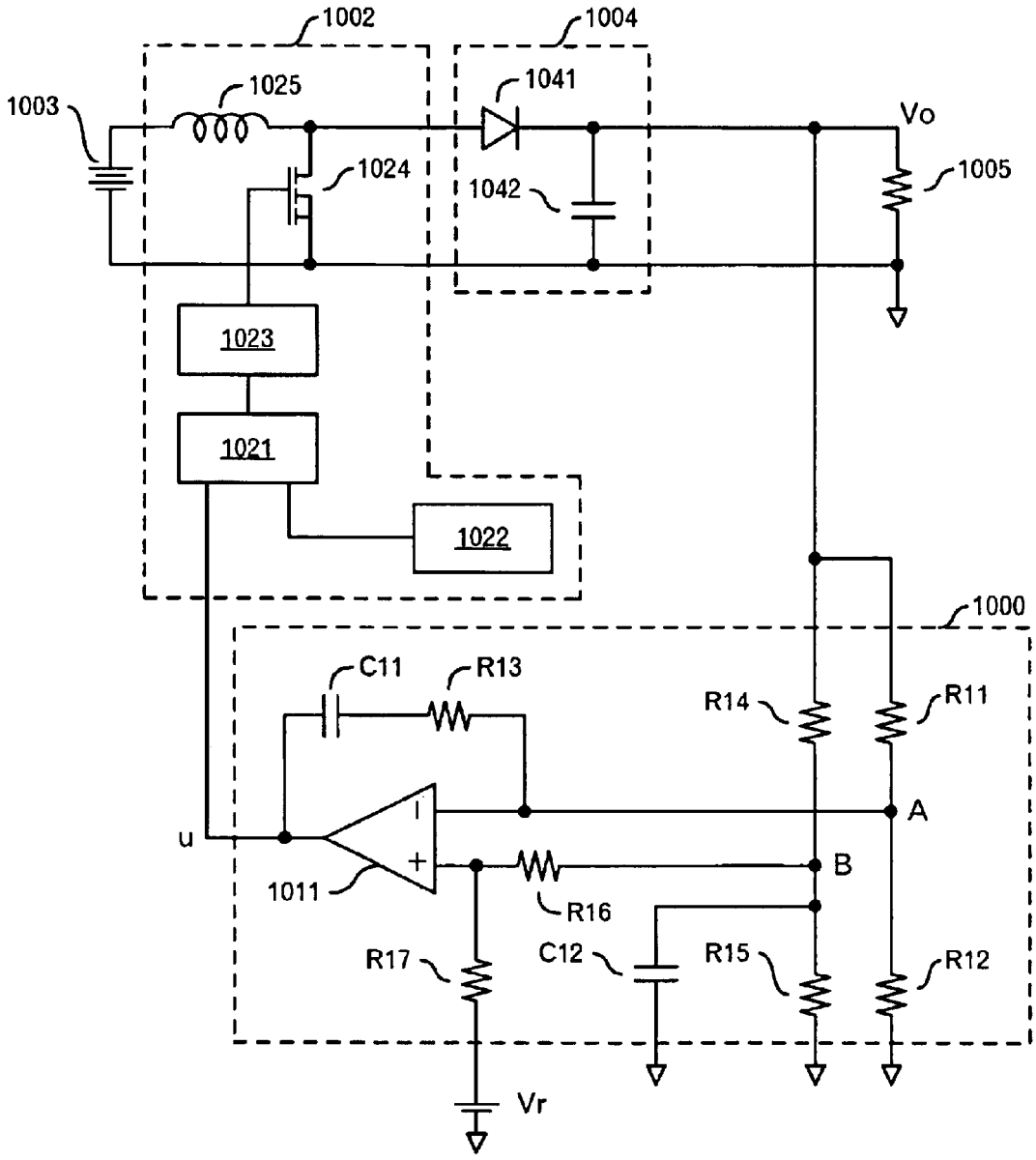
FIG.19 PRIOR ART
FIG. 19 is a diagram showing the circuit structure in the conventional technique.

Thus, in this embodiment as well as the first embodiment, the integral (I) element of the PID is applied up to a frequency range that is higher than the resonance frequency of the LC filter 1*b*, the trap point 1402 is generated. In this trap point 1402, since the gain still exceeds 0 dB and the curve of the gain has a high slope, the high speed response is achieved. Moreover, there is no problem in the stability because the phase margin is secured at the gain crossover frequency even if there is no gain margin. When the controller 2*b* is designed to achieve the frequency characteristics of the phase and the gain as shown in FIG. 15, the response ability can be improved maintaining the stability. Incidentally, because the number of circuit constants, that should be determined, is not increased, it becomes easy to design rather than the circuit shown in FIG. 19.

3. Third Embodiment

Figure 16:
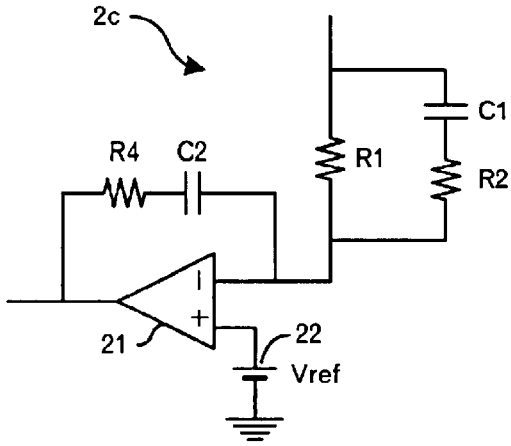
FIG. 16 is a diagram showing the circuit structure of a controller in the third embodiment of this invention.
Figure 17:
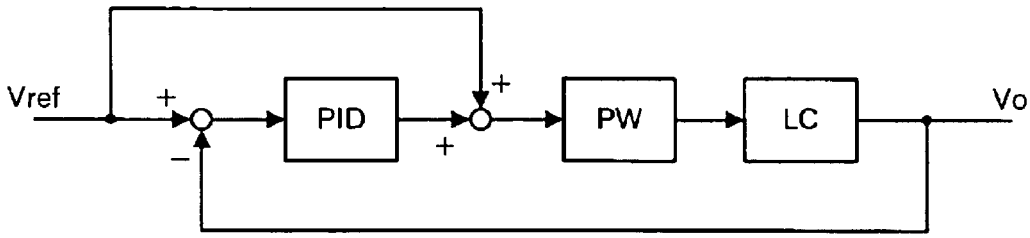
FIG. 17 is a diagram showing a block diagram in a conventional technique.

There is no difference in the number of resistors and capacitors and the connection between the controller 2 in the first embodiment and the controller 2*b* in the second embodiment, though the circuit constants are different. In the third embodiment, the circuit shown in FIG. 16 is adopted instead of the controller 2 or the controller 2*b*.

That is, it is a circuit in which the resistor R3 in the controller 2 or the controller 2*b* shown in FIG. 1 or FIG. 11 is detached. More specifically, the controller 2*c* includes resistors R1, R2 and R4, capacitors C1 and C2, an amplifier 21, and a reference voltage power supply 22. The resistor R1 and capacitor C1 are connected to the positive polarity side terminal of the load Ro of the LC filter 1. The capacitor C1 and resistor R2 are connected in series, and the capacitor C1 and resistor R2 are connected to the resistor R1 in parallel. Therefore, one terminal of the resistor R1 whose another terminal is connected to the capacitor C1 is connected to the resistor R2. The resistors R1 and R2 are connected to a negative input terminal of the amplifier 21, and is further connected to the capacitor C2. The capacitor C2 and resistor R4 are connected in series. Moreover, the resistor R4 is connected to an output terminal of the amplifier 21. The positive input terminal of the amplifier 21 is connected to the positive polarity side terminal of the reference voltage power supply 22, and the negative polarity side terminal of the reference voltage power supply 22 is grounded. The output of the amplifier 21 is connected with the PWM comparator 32. Moreover, the resistor R1 and capacitor C1 are connected to the positive polarity side terminal of the load Ro.

The transfer function of such the controller 2*c* is basically represented by the equation (2), and N0, N1, N2, D0, and D1 are represented by the resistors R1, R2 and R4, capacitors C1 and C2 as follows:

$$N_0 = \frac{1}{R1R2C1C2}$$

-continued $$N_1 = \frac{R1C1 + R2C1 + R4C2}{R1R2C1C2}$$

$$N_2 = \frac{R4(R1 + R2)}{R1R2}$$

$$D_0 = 0$$

$$D_1 = \frac{1}{R2C1}$$

If these circuit constants are determined so as to achieve the gain and phase frequency characteristic of the loop transfer function shown in FIG. 15 or FIG. 8, the effect similar to the first and second embodiments is achieved.

Incidentally, the circuit constants of this invention are not limited to only ones shown in the first and second embodiments, and if the aforementioned features can be achieved, any combination of circuit constants may be adopted.

What is claimed is:

1. A power supply apparatus, comprising:

a power converter circuit for converting an input voltage from input power supply;

an LC filter for smoothing an output of said power converter circuit and supplying the smoothed output to a load; and a controller for controlling said power converter circuit based on an output voltage of the LC filter, and wherein a transfer function (G) of said controller is represented by:

$$\frac{N_2 s^2 + N_1 s + N_0}{s^2 + D_1 s + D_0}$$

(N0, N1, N2, D0and D1 are coefficients and s is a variable), where a root of a numerator thereof is a real number, and a loop transfer function including a transfer function of said power converter circuit, said LC filter, and said load, and said transfer function (G) of said controller has an open loop characteristic that a gain margin is omitted.

2. A power supply apparatus, comprising:

a power converter circuit for converting an input voltage from an input power supply;

an LC filter for smoothing an output of said power converter circuit and supplying the smoothed output to a load; and a controller for controlling said power converter circuit based on an output voltage of said LC filter, and wherein a transfer function (G) of said controller is represented by:

$$\frac{N_2 s^2 + N_1 s + N_0}{s^2 + D_1 s + D_0}$$

(N0, N1, N2, D0 and D1 are coefficients and s is a variable), where a root of a numerator thereof is a real number, and a loop transfer function including a transfer function of said power converter circuit, said LC filter, and said load, and said transfer function (G) of said controller has an open loop characteristic that only a phase margin among said phase margin and a gain margin.

3. A power supply apparatus, comprising:

a power converter circuit for converting an input voltage from an input direct current power supply;

an LC filter for smoothing an output of said power converter circuit and supplying the smoothed output to a load; and a controller for controlling said power converter circuit based on an output voltage of said LC filter, and wherein a transfer function (G) of said controller is represented by:

$$\frac{N_2 s^2 + N_1 s + N_0}{s^2 + D_1 s + D_0}$$

(N0, N1, N2, D0 and D1 are coefficients and s is a variable), in which a root of a numerator thereof is a real number, and a loop transfer function including a transfer function of said power converter circuit, said LC filter, and said load, and said transfer function (G) of said controller has an open loop characteristic that a gain exceeds 0 dB at a frequency at which a phase becomes −180 degrees.

4. The power supply apparatus as set forth in claim 3, wherein said frequency at which said phase becomes −180 degrees is set in a frequency range from a resonance frequency of said LC filter to a gain crossover frequency.

5. A power supply apparatus, comprising:

a power converter circuit for converting an input voltage from an input direct current power supply;

an LC filter for smoothing an output of said power converter circuit and supplying the smoothed output to a load; and a controller for controlling said power converter circuit based on an output voltage of the LC filter, and wherein a transfer function (G) of said controller is represented by:

$$\frac{N_2 s^2 + N_1 s + N_0}{s^2 + D_1 s + D_0}$$

(N0, N1, N2, D0 and D1 are coefficients and s is a variable), where a root of a numerator thereof is a real number, and a loop transfer function including a transfer function of said power converter circuit, said LC filter, and said load, and said transfer function (G) of said controller has an open loop characteristic that a gain exceeds 0 dB at a frequency at which a phase is mostly delayed.

6. The power supply apparatus as set forth in claim 5, wherein said frequency with at which said phase is mostly delayed is set in a frequency range from a resonance frequency of said LC filter to a gain crossover frequency.

7. A power supply apparatus, comprising:

a power converter circuit for converting an input voltage from an input direct current power supply;

an LC filter for smoothing an output of said power converter circuit and supplying the smoothed output to a load; and a controller for controlling said power converter circuit based on an output voltage of the LC filter, and wherein said controller has a PID control function whose transfer function (G) is represented by:

$$\frac{N_2 s^2 + N_1 s + N_0}{s^2 + D_1 s + D_0}$$

(N0, N1, N2, D0 and D1 are coefficients and s is a variable), in which a root of a numerator thereof is a real number, and at frequencies higher than a resonance frequency of said LC filter, an integral control element is applied to said transfer function (G) of said controller.

8. The power supply apparatus as set forth in claim 7, wherein said controller applies a differential control element to said transfer function (G) of said controller at frequencies that are lower than a gain crossover frequency.

* * * * *